US010453631B1

(12) United States Patent
Chang

(10) Patent No.: US 10,453,631 B1
(45) Date of Patent: Oct. 22, 2019

(54) STROKE ADJUSTMENT COVER FOR CLIP-TYPE MICRO SWITCH

(71) Applicant: ZIPPY TECHNOLOGY CORP., New Taipei (TW)

(72) Inventor: Che-Wei Chang, New Taipei (TW)

(73) Assignee: ZIPPY TECHNOLOGY CORP., New Taipei (TW)

( * ) Notice: Subject to any disclaimer, the term of this patent is extended or adjusted under 35 U.S.C. 154(b) by 0 days.

(21) Appl. No.: 16/103,495

(22) Filed: Aug. 14, 2018

(51) Int. Cl.

| | |
|---|---|
| ***H01H 21/04*** | (2006.01) |
| ***H01H 21/22*** | (2006.01) |
| ***H01H 21/24*** | (2006.01) |
| ***H01H 21/86*** | (2006.01) |

(52) U.S. Cl.
CPC ..... *H01H 21/22* (2013.01); *H01H 21/04* (2013.01); *H01H 21/24* (2013.01); *H01H 21/86* (2013.01); *H01H 2021/225* (2013.01); *H01H 2221/08* (2013.01)

(58) Field of Classification Search
CPC ..... H01H 21/22; H01H 21/24; H01H 21/04; H01H 21/86; H01H 2021/225; H01H 2221/08; H01H 1/365; H01H 1/44; H01H 23/205; H01H 25/04; H01H 13/14; H01H 13/186; H01H 3/46
USPC .... 200/559, 563, 16 C, 16 D, 536, 537, 553, 200/557, 558, 573, 6 B, 6 BB, 6 R
See application file for complete search history.

(56) References Cited

U.S. PATENT DOCUMENTS 6,242,706 B1 * 6/2001 Miyata ..... H01H 21/28 200/537
7,538,291 B1 * 5/2009 Cheng ..... H01H 13/36 200/468

FOREIGN PATENT DOCUMENTS

| | | |
|---|---|---|
| TW | I315535 B | 10/2009 |
| TW | I449069 B | 8/2014 |
| TW | I449070 B | 8/2014 |

* cited by examiner

*Primary Examiner* — Ahmed M Saeed
(74) *Attorney, Agent, or Firm* — Muncy, Geissler, Olds & Lowe, P.C.

(57) ABSTRACT

A stroke adjustment cover for clip-type micro switch, the stroke adjustment cover comprises a cover body connected to a clip-type micro switch, a stroke adjustment member disposed in the cover body, and an elastic member used to provide the stroke adjustment member with a reciprocating stroke perpendicular to the direction of an actuation stroke of the clip-type micro switch. Through an adjustment section of the stroke adjustment member includes at least one brake portion used for braking the clip-type micro switch to generate the actuation stroke in the reciprocating stroke provided by the elastic member. The present invention not requires modification of the actuation stroke and structure of the clip-type micro switch, while an actuation time of a switching command signal of the clip-type micro switch is extended by the stroke adjustment cover provided with the different reciprocating strokes and being easy to install.

6 Claims, 5 Drawing Sheets

STROKE ADJUSTMENT COVER FOR CLIP-TYPE MICRO SWITCH

FIELD OF THE INVENTION

The present invention relates to a stroke adjustment cover for clip-type micro switch, and more particularly to a spring type micro switch which is used for actuating a switching command signal output through a very short displacement stroke actuated mechanically.

BACKGROUND OF THE INVENTION

Micro switch is widely used in small electronic devices, which is an adjacent contact control element for turning on or off a circuit for achieving the turning on and off or protection function of the electronic device. Among them, the application of the clip-type micro switch is the most common. For related patents, please refer to Taiwan Patent No. I449069B, Taiwan Patent No. 1449070B, Taiwan Patent No. I315535B, U.S. Pat. No. 7,538,291B, etc. The micro switch usually comprises a switch body, an actuate member disposed on the switch body, and a clip-type switching component disposed inside the switch body for actuating at least one switching command signal subjected to an actuation stroke generated by a displacement of the actuate member.

Since the applied electronic device requires different pressing strokes, please refer to FIG. 1 for a schematic diagram of a conventional micro switch capable of controlling an actuation stroke. As shown in the FIG. 1, a micro switch 30 is disposed with a metal pressing member 32 extending at an oblique angle at one end of an actuate member 31, and a different actuation stroke is achieved by the spacing between the pressing and connecting member 32 and the actuate member 31. However, a fixed section of the micro switch 30 to which the pressing and connecting member 32 is fixedly connected is used as a fulcrum to generate a reciprocating stroke by the metal flexibility of the pressing and connecting member 32 itself. That is, the actuation stroke cannot be precisely controlled in production, and the metal elastic fatigue of the pressing and connecting member 32 is also likely to occur due to long-term use to cause the actuation stroke error. In addition, because the height of an extension end of the pressing and connecting member 32 is too high, interference problems with parts installation occur often due to the miniaturization of electronic devices nowadays, which limit the margin of adjusting the actuation stroke.

SUMMARY OF THE INVENTION

A main object of the present invention is to solve the problem that the conventional clip-type micro switches cannot achieve an effective adjustable stroke.

In order to achieve the above object, the present invention provides a stroke adjustment cover for a clip-type micro switch. The stroke adjustment cover comprises a cover body connected to a clip-type micro switch, a stroke adjustment member disposed in the cover body, and an elastic member used to provide the stroke adjustment member with a reciprocating stroke perpendicular to an actuation stroke direction of the clip-type micro switch. Through an adjustment section of the stroke adjustment member includes at least one brake portion used for braking the clip-type micro switch to generate the actuation stroke in the reciprocating stroke provided by the elastic member. The present invention not requires modification of the actuation stroke and structure of the micro switch, while an actuation time of a switching command signal of the micro switch is extended by the stroke adjustment cover provided with the different reciprocating strokes and being easy to install. Through the foregoing description of the present invention, compared with the conventional clip-type micro switches, the present invention has the following features:

The stroke adjustment cover of the present invention adopts an external connection mode to connect the clip-type micro switch, and the clip-type micro switch does not need to be additionally modified in structure and can be produced in module.

The stroke adjustment cover of the present invention requires less assembly space than the conventional metal pressing and connecting plate of stroke adjustment, and the stroke adjustment cover includes the cover body assembled to the clip-type micro switch, thereby effectively reducing the degree of interference with internal parts of the application electronic device.

The stroke adjustment cover of the present invention determines the adjustable actuation stroke of the clip-type micro switch through the structure of the brake portion on the adjustment section of the stroke adjustment member and a length of the reciprocating stroke of the elastic member, which is more precise and have more adjustable margin compared with conventional designs.

DETAILED DESCRIPTION OF THE PREFERRED EMBODIMENTS

Figure 1:
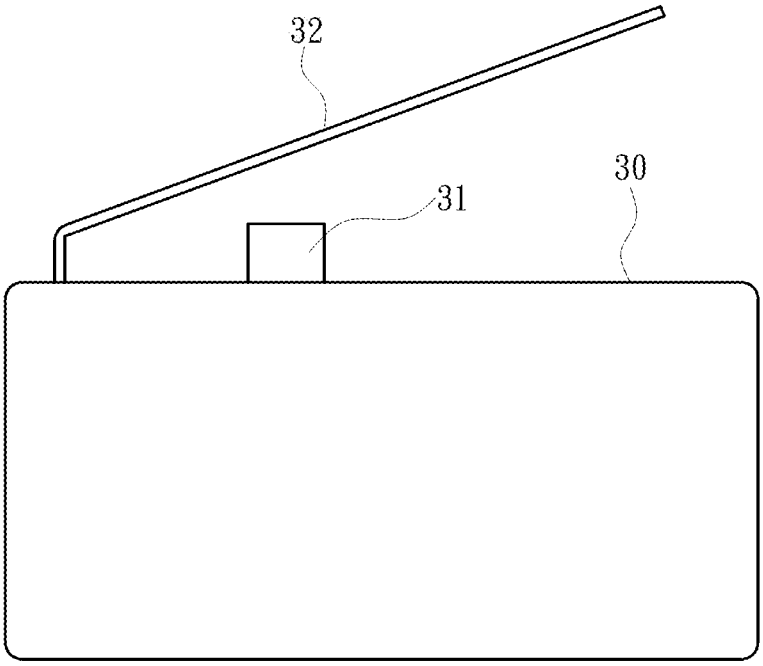
Fig. 1 PRIOR ART
FIG. 1 is a schematic diagram of a conventional micro switch capable of controlling an actuation stroke.
Figure 2:
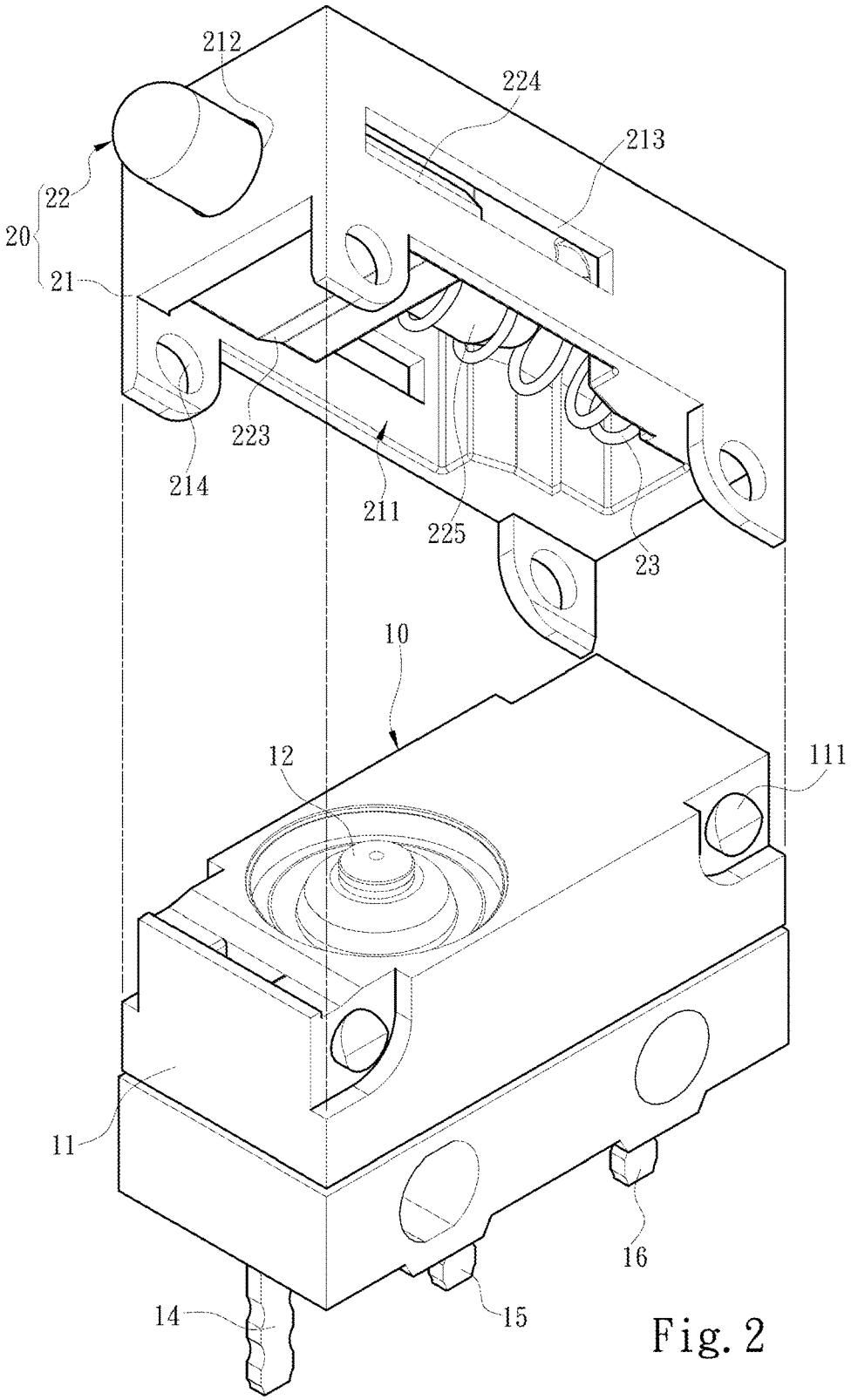
FIG. 2 is an exploded perspective view of an embodiment of the present invention.
Figure 3:
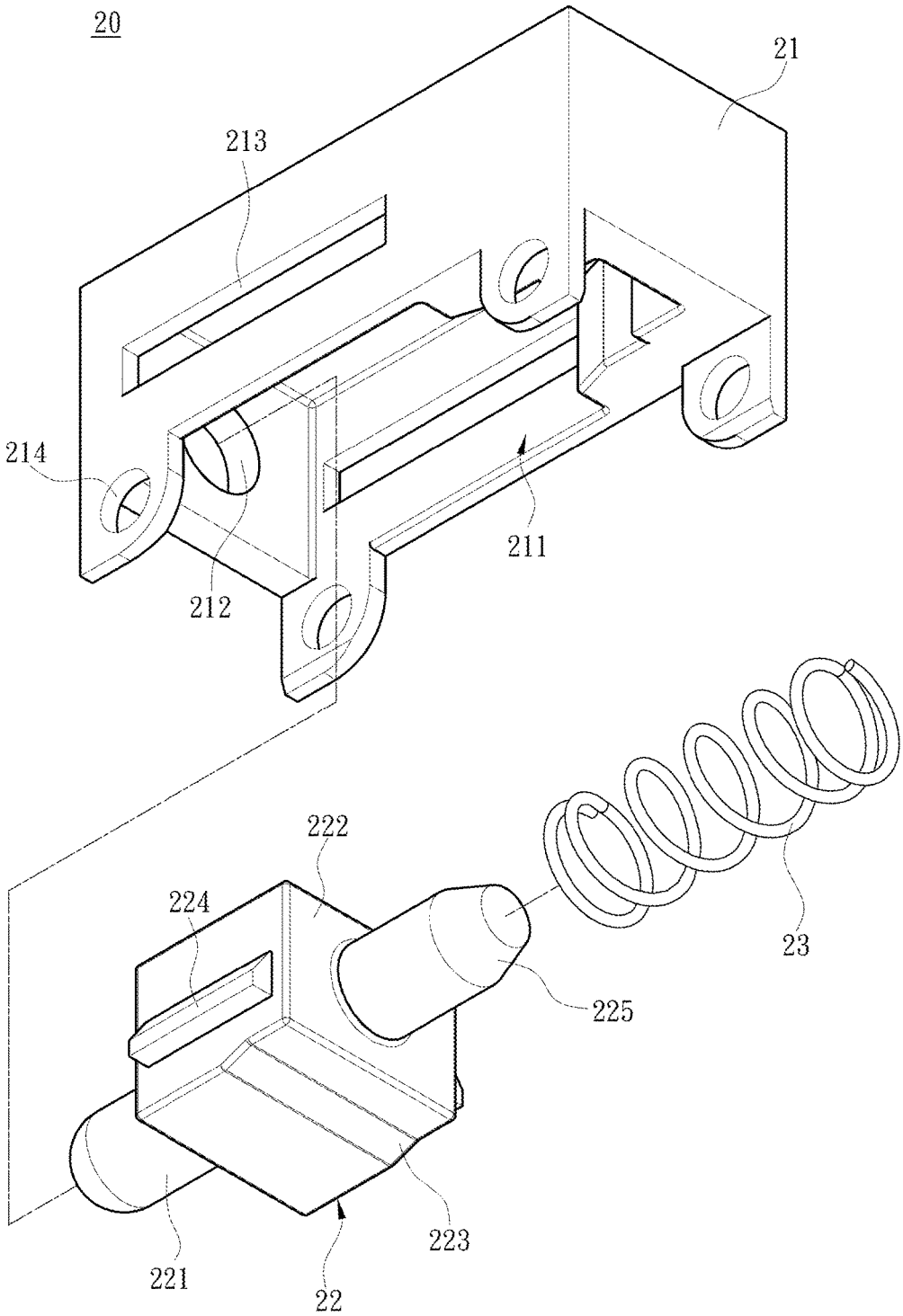
FIG. 3 is an exploded perspective view of a stroke adjustment cover of an embodiment of the present invention.
Figure 4:
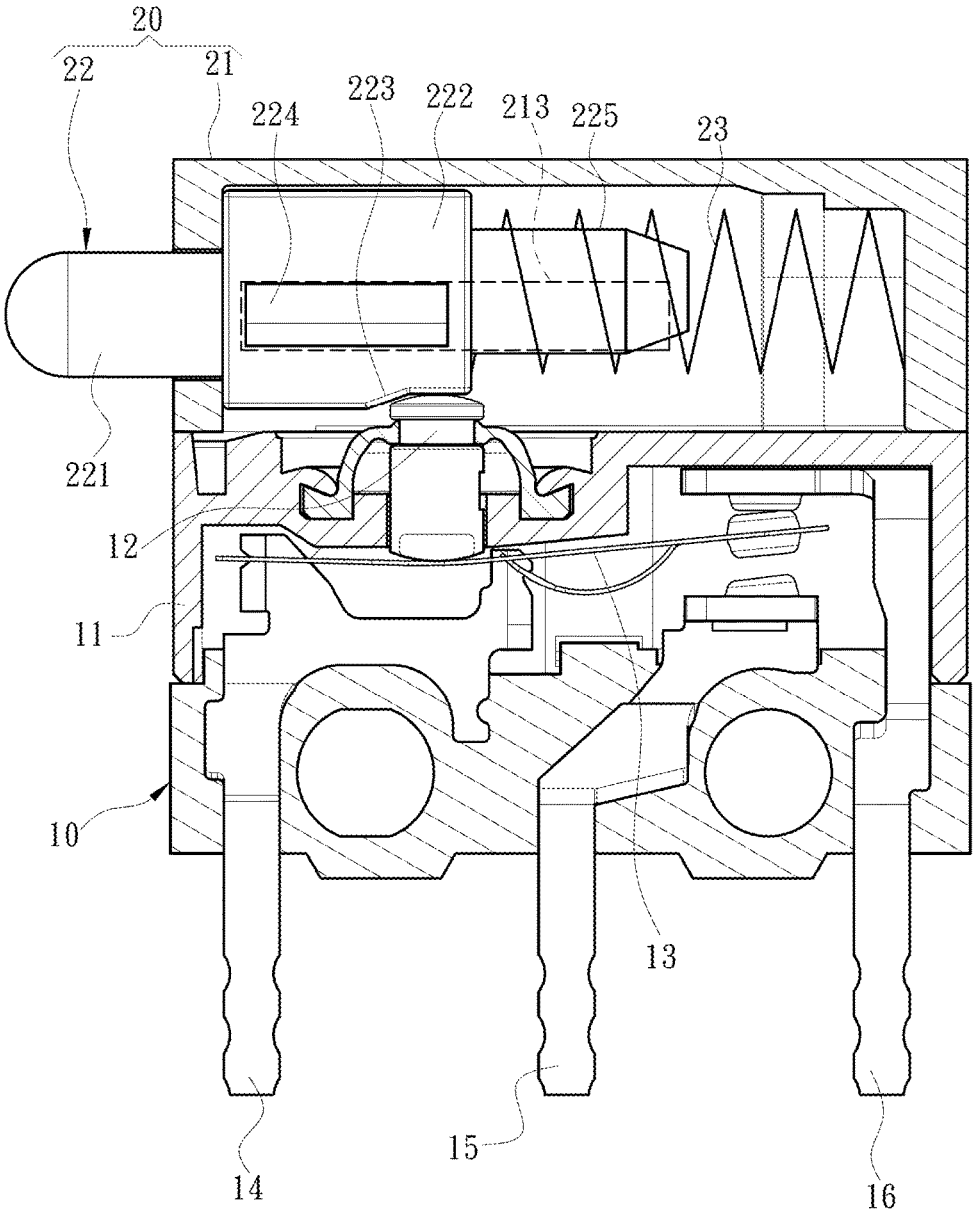
FIG. 4 is a cross-sectional view of an embodiment of the present invention in an original state.
Figure 5:
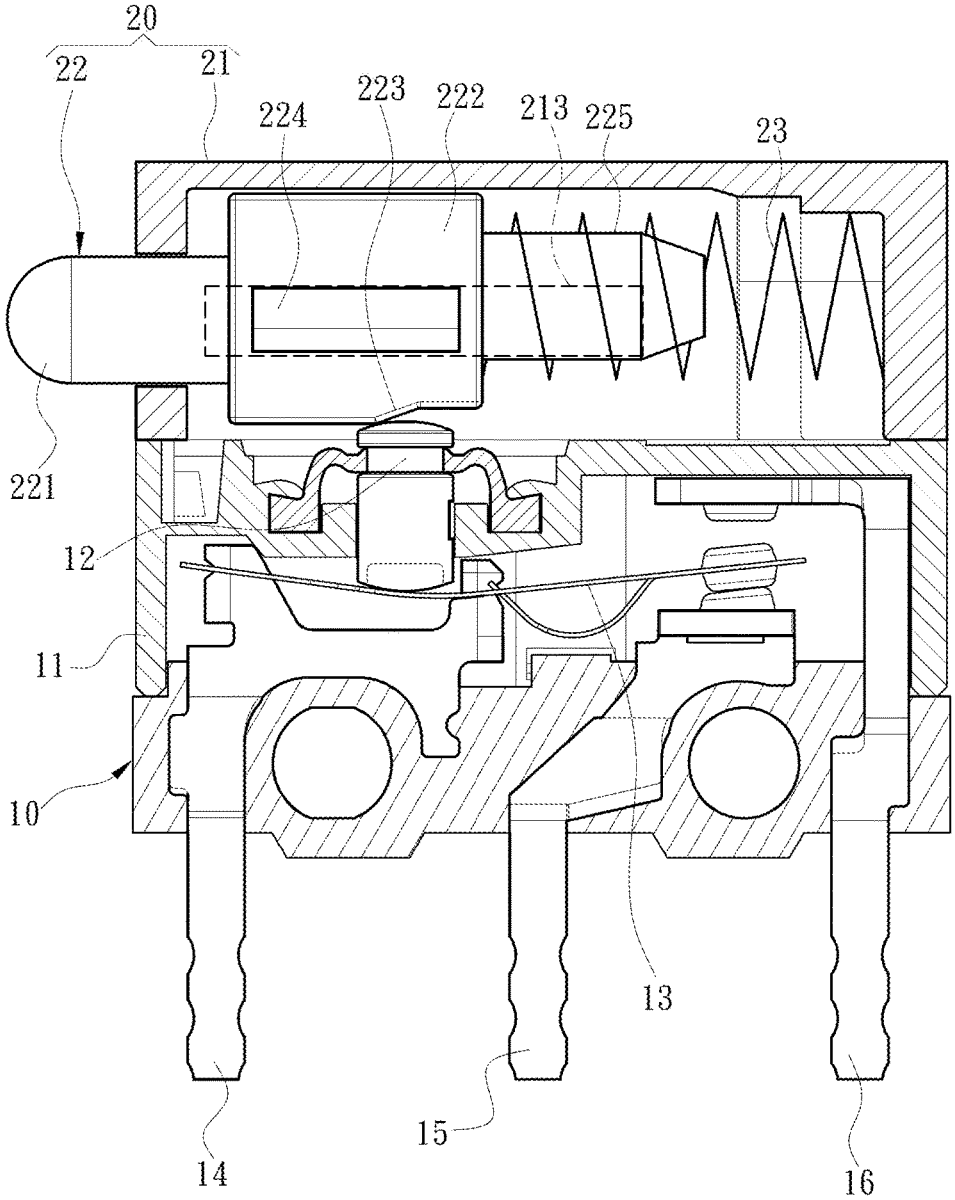
FIG. 5 is a cross-sectional view of an embodiment of the present invention in an actuation state.

The detailed description and technical content of the present invention will be described as follows in conjunction with the drawings:

Referring to FIGS. 2, 3 and 4, the present invention provides a stroke adjustment cover 20 for a clip-type micro switch 10. The clip-type micro switch 10 comprises a switch body 11, an actuate member 12 disposed on the switch body 11, and a clip-type switching component disposed inside the switch body 11 for actuating at least one switching command signal subjected to an actuation stroke generated by a displacement of the actuate member 12. The clip-type switching component comprises a conductive connection member 13 subjected to braking by the actuate member 12, and a first conductive pin 14, a second conductive pin 15 and a third conductive pin 16 connected to the conductive connection member 13. The conductive connection member 13 has a normal position and an actuating position corresponding to the actuation stroke of the actuate member 12. At the normal position, the first conductive pin 14 and the third conductive pin 16 is conducted, and at the actuating position, the first conductive pin 14 and the second conductive pin 15 is conducted to cause the clip-type switching component to generate the switching command signal.

Based on the actuating mode of the clip-type switching component of the clip-type micro switch 10 is well-known and has been widely used in the art, the stroke adjustment cover 20 of the present invention is able to be for any micro switch with the same technology of the clip-type micro switch 10 without being limited by the drawings of the present invention.

Furthermore, the stroke adjustment cover 20 of the present invention comprises a cover body 21 approximately corresponding to the size and shape of the switch body 11 and correspondingly disposed with at least one connecting member, a stroke adjustment member 22 disposed in the cover body 21, and an elastic member 23 disposed in the cover body 21 and providing the stroke adjustment member 22 with a reciprocating stroke which is perpendicular to the direction of the actuation stroke. The cover body 21 is disposed with at least one first opening 211 equal to or smaller than a top surface area of the switch body 11 and being in the same direction as the displacement of the actuate member 12, and at least one second opening 212 adjacent to the first opening 211 and relatively perpendicular to the direction of the displacement of the actuate member 12. The stroke adjustment member 22 comprises a pressing section 221 penetratingly disposed in the second opening 212 and exposed outside the cover body 21, and an adjustment section 222 located at the position of the first opening 211 in the cover body 21 and connecting the elastic member 23. The adjustment section 222 includes at least one brake portion 223 used for braking the displacement of the actuate member 12 to generate the actuation stroke through the reciprocating stroke provided by the elastic member 23 in the stroke adjustment member 22.

Referring to FIGS. 2, 3 and 4 again, for convenient installation of the cover body 21 of the stroke adjustment cover 20, the connecting member includes a first assembly portion 111 and a second assembly portion 214 correspondingly disposed at four endpoint positions of the switch body 11 and the cover body 21 respectively for assembling. In the original state in which the cover body 21 and the switch body 11 are assembled, the actuate member 12 will be relatively disposed below the adjustment section 222 of the stroke adjustment member 22. The actuate member 12 selectively abuts the adjustment section 222 or maintain a certain distance from the adjustment section 222 according to different preset adjustment stroke lengths. The brake portion 223 is a guide inclined surface formed from the adjustment section 222 for braking the actuate member 12. Corresponding to the shape of the actuate member 12 being circular or square, the guide inclined surface is designed as a plane and straight slope or a curved surface slope. Referring to FIG. 4, the distance of the brake portion 223 in the original state relatives to the actuate member 12 is proportionally increased or decreased according to different preset stroke adjustments. Furthermore, the adjustment section 222 and the cover body 21 are correspondingly disposed with at least one displacement portion 224 and at least one limitation portion 213 respectively for assisting the reciprocating stroke, and the adjustment section 222 further comprises a support portion 225 which extends from the adjustment section 222 for connecting a portion of the elastic member 23. Besides, the limitation portion 213 and the support portion 225 described above assist the stroke adjustment member 22 to be more smoothly and steadily displaced during the reciprocating stroke by using the elastic member 23. At the same time, the limitation portion 213 and the support portion 225 are also provided to limit the stroke adjustment member 22 not to exceed the maximum range of the reciprocating stroke displacement, thereby effectively reducing damages caused to the clip-type micro switch 10 or otherwise the stroke adjustment member 22 would be in a state of not being able to restore.

Referring to FIGS. 2, 3, 4 and 5, FIG. 5 is a cross-sectional view of an embodiment of the present invention in an actuation state. When the present invention is subject to an external force to actuate the clip-type micro switch 10 of the original state shown in FIG. 4, the pressing section 221 of the stroke adjustment member 22 is subject to the external force and interlinkingly actuate the adjustment section 222 to compress the elastic member 23 for reserving a restoring elastic force so that the elastic member 23 starts generating the reciprocating stroke. At this time, the stroke adjustment member 22 is displaced towards the direction of the elastic member 23, so that the brake portion 223 of the adjustment section 222 is pressed against the actuate member 12 of the clip-type micro switch 10, and the actuate member 12 is changed to actuate the conductive connection member 13 of the switching component downwardly in a direction relatively perpendicular to the direction of the displacement of the stroke adjustment member 22 to start an actuation stroke. Corresponding to the actuation stroke of the actuate member 12, the conductive connection member 13 is caused to switch from the normal position for conducting the first conductive pin 14 and the third conductive pin 16 in the original state shown in FIG. 4 to the actuating position for conducting the first conductive pin 14 and the second conductive pin 15 to cause the clip-type switching component to generate the switching command signal output.

To continue from the above, when the external force is eliminated, the clip-type micro switch 10 returns to the normal position by using the flexibility change of the conductive connection member 13 while the actuate member 12 is pushed to return to an original position, and the stroke adjustment member 22 completes the reciprocating stroke as it is pushed back to an original position shown in FIG. 4 via the restoring elastic force stored in the aforementioned elastic member 23.

In summary, the stroke adjustment member 22 of the present invention is easily assembled and disassembled with the clip-type micro switch 10 through the cover body 21 structure, and the stroke adjustment range is increased through the relative distance between the brake portion 223 and the actuate member 12, the structure of the brake portion 223 corresponding to the shape of the actuate member 12, and the like. The stroke adjustment member 22 and the elastic member 23 are provided with the protection of the cover body 21 for reducing interference problems with installing other parts in the electronic device. More importantly, the clip-type micro switch 10 to which the present invention is applied does not need to be additionally modified the structure, and the different stroke adjustment covers 20 is installed according to the requirements of different stroke adjustments to effectively expand the stroke adjustment range.

What is claimed is:

1. A stroke adjustment cover for clip-type micro switch, comprising:

a clip-type micro switch comprising a switch body, an actuate member disposed on the switch body, and a clip-type switching component disposed inside the switch body for actuating at least one switching command signal subjected to an actuation stroke generated by a displacement of the actuate member; and a stroke adjustment cover, the stroke adjustment cover comprising a cover body disposed with at least one connecting member corresponding to the switch body, a stroke adjustment member disposed in the cover body, and an elastic member disposed in the cover body and used to provide the stroke adjustment member with a reciprocating stroke perpendicular to the actuation stroke, the cover body disposed with at least one first opening in the same direction as the displacement of the actuate member, and at least one second opening adjacent to the first opening and relatively perpendicular to the displacement of the actuate member, the stroke adjustment member comprising a pressing section penetratingly disposed in the second opening and exposed outside the cover body, and an adjustment section located at a position of the first opening in the cover body and connecting the elastic member, the adjustment section and the cover body are correspondingly disposed with at least one displacement portion and at least one limitation portion respectively for assisting the reciprocating stroke, the adjustment section and the cover body are correspondingly disposed with at least one displacement portion and at least one limitation portion respectively for assisting the reciprocating stroke, the adjustment section including at least one brake portion used for braking the displacement of the actuate member to generate the actuation stroke through the reciprocating stroke provided by the elastic member in the stroke adjustment member.

2. The stroke adjustment cover for clip-type micro switch according to claim 1, wherein the clip-type switching component comprises a conductive connection member subjected to braking by the actuate member, and a first conductive pin, a second conductive pin and a third conductive pin connected to the conductive connection member, the conductive connection member has a normal position and an actuating position corresponding to the actuation stroke of the actuate member, the first conductive pin and the third conductive pin is conducted at the normal position, and the first conductive pin and the second conductive pin is conducted at the actuating position to cause the clip-type switching component to generate the switching command signal.

3. The stroke adjustment cover for clip-type micro switch according to claim 1, wherein the connecting member includes a first assembly portion and a second assembly portion correspondingly disposed at four endpoint positions of the switch body and the cover body respectively.

4. The stroke adjustment cover for clip-type micro switch according to claim 1, wherein the first opening is equal to or smaller than a top surface area of the switch body.

5. The stroke adjustment cover for clip-type micro switch according to claim 1, wherein the adjustment section further comprises a support portion which extends from the adjustment section for connecting a portion of a section of the elastic member.

6. The stroke adjustment cover for clip-type micro switch according to claim 1, wherein the brake portion is a guide inclined surface formed from the adjustment section for braking the actuate member.

* * * * *